US009326554B2

(12) United States Patent
Lou et al.

(10) Patent No.: US 9,326,554 B2
(45) Date of Patent: May 3, 2016

(54) FUNCTIONAL PANTS

(71) Applicants: Ming-Yao Lou, Taichung (TW); Marvin Wei, Taichung (TW)

(72) Inventors: Ming-Yao Lou, Taichung (TW); Marvin Wei, Taichung (TW)

( * ) Notice: Subject to any disclaimer, the term of this patent is extended or adjusted under 35 U.S.C. 154(b) by 456 days.

(21) Appl. No.: 13/828,006

(22) Filed: Mar. 14, 2013

(65) Prior Publication Data

US 2014/0059741 A1 Mar. 6, 2014

(30) Foreign Application Priority Data

Aug. 29, 2012 (TW) ..... 101131423 A

(51) Int. Cl.
*A41D 1/08* (2006.01)
*A41D 1/06* (2006.01)
*A41D 13/00* (2006.01)

(52) U.S. Cl.
CPC .. *A41D 1/06* (2013.01); *A41D 1/08* (2013.01); *A41D 13/0015* (2013.01)

(58) Field of Classification Search
CPC ..... A41B 11/00; A41D 2400/38; A41D 2600/102; A41D 2600/10; A41D 2600/104; A41D 1/06; A41D 1/08; A41D 1/082; A41D 1/086; A41D 1/10; A41D 13/05; A41D 13/0506; A41D 13/0537; A41D 13/0543; A41D 13/0015
USPC ..... 2/227
See application file for complete search history.

(56) References Cited

U.S. PATENT DOCUMENTS 7,516,498 B2 * 4/2009 Torry ..... 2/69
8,533,864 B1 * 9/2013 Kostrzewski ..... 2/69

FOREIGN PATENT DOCUMENTS

WO WO 2011124849 A1 * 10/2011

* cited by examiner

*Primary Examiner* — Andrew W Collins
*Assistant Examiner* — Jody Erickson
(74) *Attorney, Agent, or Firm* — Muncy, Geissler, Olds & Lowe, P.C.

(57) ABSTRACT

Functional pants include a pant body, two front bands, two rhombic bands and two back bands. The two rhombic bands are disposed corresponding to the wearer's gluteus medius muscles that work to extend and lift the legs during a long-distance running. The rhombic bands are adapted to enhance the extensibility and reduce fatigue of the gluteus medius muscles. The front and back bands alternatively impart a stretching force to the wearer when the wearer's legs are repeatedly kicking and lifting during running, enabling the wearer to run with less effort. Thus, the functional pants have a significant effect on reducing fatigue, and are suitable for long-distance runners.

7 Claims, 8 Drawing Sheets

FUNCTIONAL PANTS

BACKGROUND OF THE INVENTION

1. Field of the Invention

The present invention relates to pants and more particularly, to functional pants that impart a stretching force to particular muscles of the wearer, reducing muscle fatigue.

2. Description of the Related Art

Many fitness pants claimed to be able to enhance sports performance are commercially available. The working principle of these commercial fitness pants is to impart a pressure to the legs, tightening up the muscles. Fitness pants providers pointed out that this method will help to enhance the explosive force.

However, to a long-distance runner, immediate explosive power is not the major consideration. Instead, durability is the most importance factor to be taken into account. Therefore, the reduction of muscle fatigue accumulation is of the most concern. However, conventional fitness pants do not provide a significantly performance in reducing fatigue accumulation.

Therefore, it is desirable to provide functional pants that effectively reduce fatigue accumulation of the muscles of the legs (more particularly, the muscles of the hips).

SUMMARY OF THE INVENTION

The present invention has been accomplished under the circumstances in view. It is the main object of the present invention to provide functional pants that impart a stretching force to local muscles of the legs, effectively reducing muscle fatigue.

To achieve this and other objects of the present invention, functional pants comprise a pant body, two front bands, two rhombic bands and two back bands. The pant body comprises left and right halves. Each of the left and right halves comprises a hip part and a thigh part. The junction between the two thigh parts defines a crotch. The bottom side of each hip part kept equal to the elevation of the crotch.

The two front bands are respectively mounted at the left and right halves of the pant body in the middle in width of the respective front side thereof and extending in the vertical direction. Each front band has the top end thereof located at the top side of the associating hip part, and the bottom end thereof located at the bottom side of the associating thigh part.

The two rhombic bands are respectively mounted at the hip parts of the left and right halves of the pant body in the middle in width of the respective back side thereof. Each rhombic band has the top end thereof located at the top side of the associating hip part, and the bottom end thereof located at the bottom side of the associating hip part. Further, each rhombic band defines a stretch region that has a width gradually increasing in a direction from the top end of the respective rhombic band toward the bottom end of the respective rhombic band and then gradually reducing toward the bottom end of the respective rhombic band. The widest area of the stretch region corresponds to one half of the height of the associating hip part.

The two back bands are respectively mounted at the thigh parts of the left and right halves of the pant body in the middle in width of the respective back side thereof and extending in the vertical direction. Each back band has the top end thereof connected to the bottom end of the associating rhombic band, and the bottom end thereof located at the bottom side of the associating thigh part.

Further, the front bands, the rhombic bands and the back bands are adapted to impart a stretching force to the wearer wearing the functional pants.

Based on the aforesaid design, the two rhombic bands are disposed corresponding to the wearer's gluteus medius muscles that work to extend and lift the legs during a long-distance running. The rhombic bands enhance the extensibility of the gluteus medius muscles, reducing fatigue. Further, the front and back bands alternatively impart a stretching force to the wearer when the wearer's legs are repeatedly kicking and lifting during running, enabling the wearer to run with less effort. Thus, the functional pants have a significant effect on reducing fatigue, and are suitable for long-distance runners.

Other advantages and features of the present invention will be fully understood by reference to the following specification in conjunction with the accompanying drawings, in which like reference signs denote like components of structure.

DETAILED DESCRIPTION OF THE INVENTION

Figure 1:
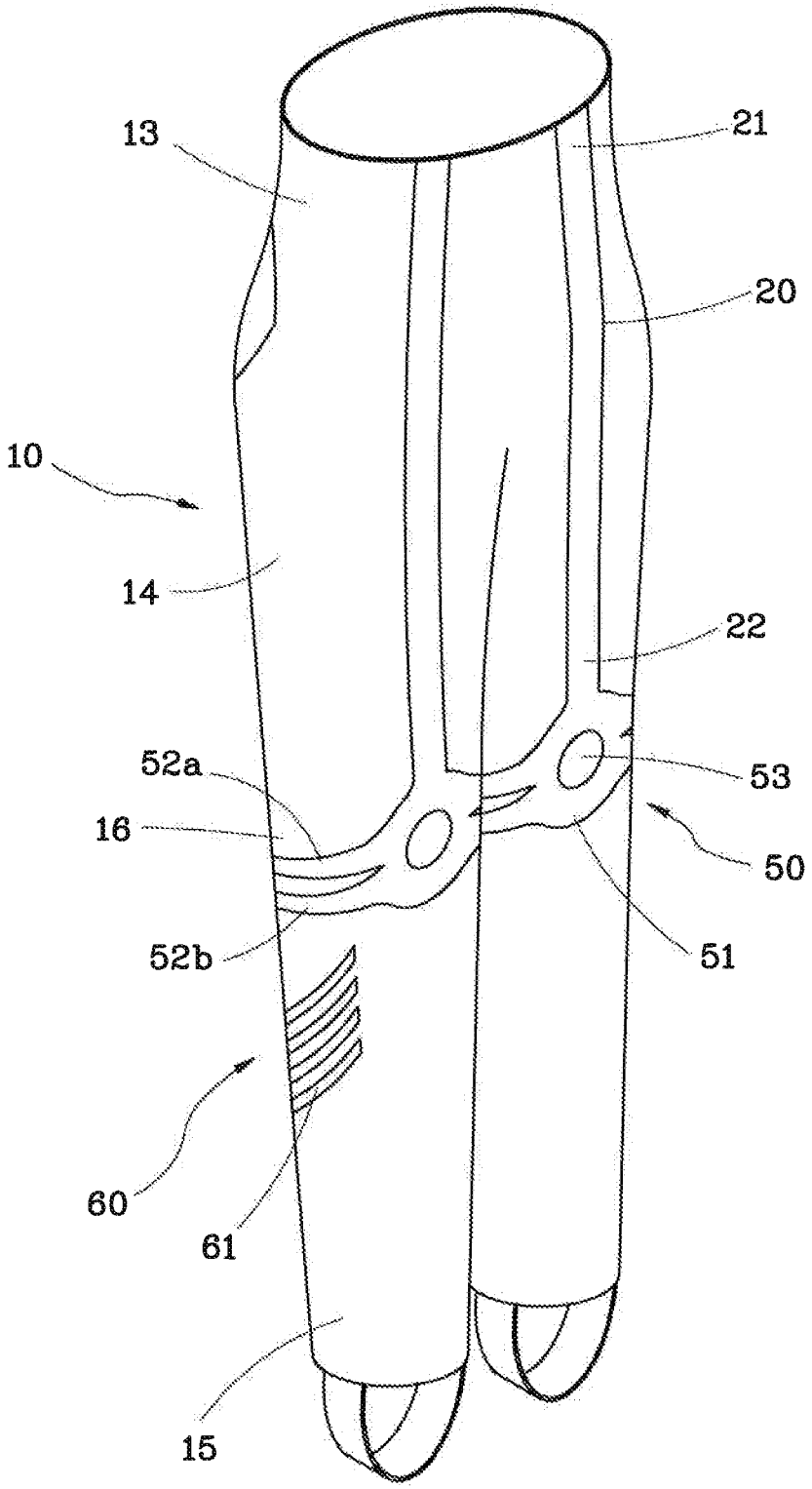
FIG. 1 is an elevational view of functional pants in accordance with a first embodiment of the present invention.
Figure 2:
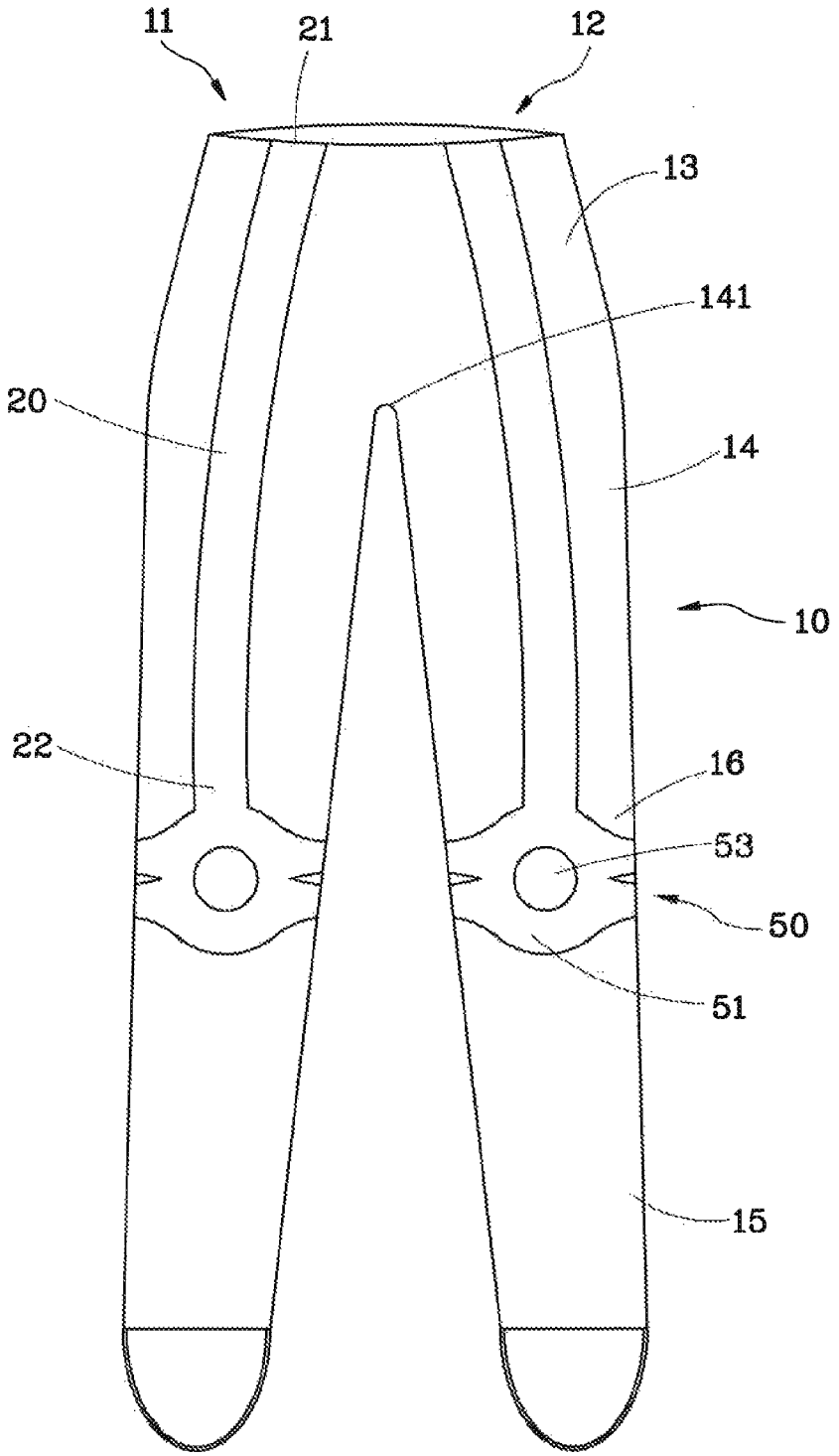
FIG. 2 is a front view of the functional pants in accordance with the first embodiment of the present invention.
Figure 3:
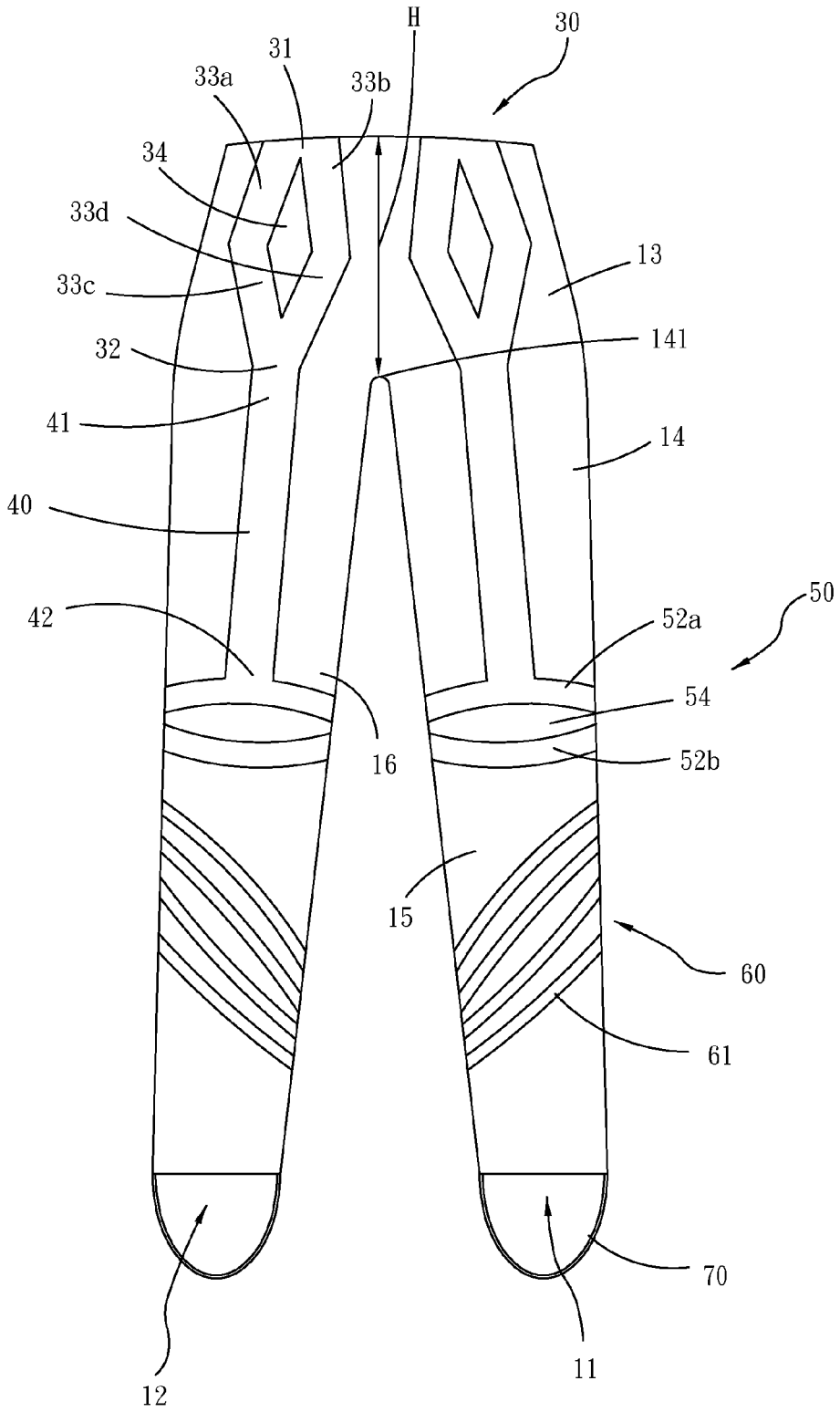
FIG. 3 is a rear side view of the functional pants in accordance with the first embodiment of the present invention.

Referring to FIGS. 1-3, functional pants in accordance with a first embodiment of the present invention is shown comprising a pant body 10, two front bands 20, two rhombic bands 30, two back bands 40, two knee bands 50, and two calf band sets 60.

The pant body 10 comprises a left half 11 and a symmetrical right half 12 sealed together. Each of the left and right halves 11, 12 comprises a hip part 13, a thigh part 14, a calf part 15, and a knee part 16. The junction between the two thigh parts 14 is defined as a crotch 141. Each hip part 13 has its bottom side kept at the same elevation as the crotch 141. Each knee part 16 is connected between the associating thigh part 14 and the associating calf part 15. The pant body 10 can be made of natural or synthetic fibers, such as cotton, nylon fibers, and polyester fibers. Further, the pant body 10 has appropriate stretchability enabling the functional pants to well fit the body of the wearer.

The two front bands 20 are respectively mounted at the left and right halves 11, 12 of the pant body 10 in the middle in width of the respective front side thereof, and extending in the vertical direction. Each front band 20 has a top end 21 located at the top side of the associating hip part 13, and a bottom end 22 located at the bottom side of the associating thigh part 14. Further, the front bands 20 are adapted to impart a stretching force to the wearer wearing the functional pants.

The two rhombic bands 30 are respectively mounted at the hip parts 13 of the left and right halves 11, 12 of the pant body 10 in the middle in width of the respective back side thereof. Each rhombic band 30 has a top end 31 located at the top side of the associating hip part 13, and a bottom end 32 located at the bottom side of the associating hip part 13, i.e., substantially equal to the elevation of the crotch 141.

According to the literal definition, each rhombic band 30 comprises four side strips 33*a*, 33*b*, 33*c*, 33*d*, wherein the top end 31 is located at the junction between two adjacent side strips 33*a*, 33*b*; the bottom end 32 is located at the junction between the other two adjacent side strips 33*c*, 33*d*. The area surrounded by the side strips 33*a*, 33*b*, 33*c*, 33*d* is defined as a stretch region 34. The stretch region 34 has a shape gradually increasing in width in a direction from the top end of the respective rhombic band toward the bottom end of the respective rhombic band in an upper part of the stretch region and then gradually reducing toward the bottom end of the respective rhombic band in a lower part of the stretch region.

Figure 3A:
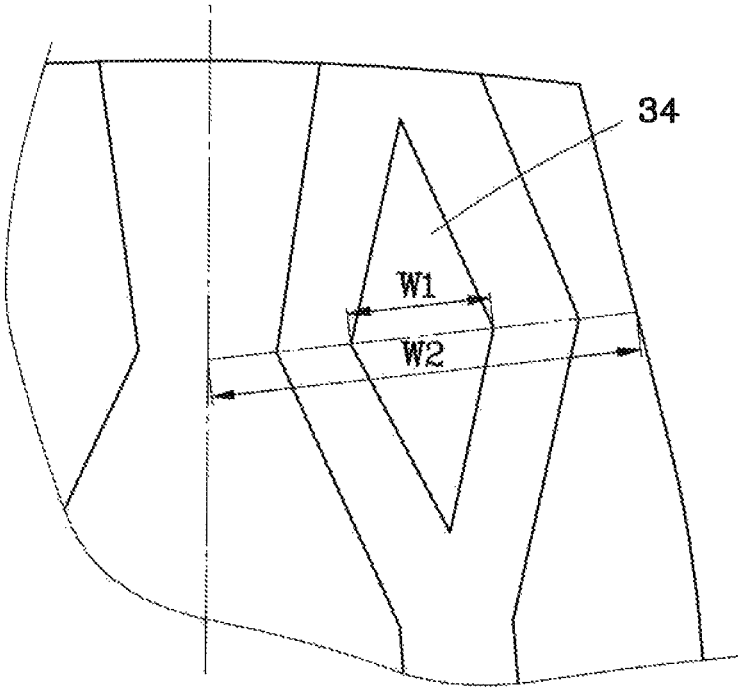
FIG. 3A is an enlarged view of a part of FIG. 3.

The widest area of the stretch region 34 is corresponding to one half of the height H of the associating hip part 13. Further, the rhombic bands 30 are adapted to impart a stretching force to the wearer wearing the functional pants. Further, as shown in FIG. 3A, the widest area of the stretch region 34 defines a first width W1. The back side of each hip part 13 defines a second width W2 corresponding to the widest area of the stretch region 34.

The first width W1 is substantially one third of the second width W2. Based on this design, the wearer's gluteus medius muscles can be covered by the stretch regions 34 of the rhombic bands 30 respectively, and the center of the gluteus medius muscles are substantially at the centers of the stretch regions 34 respectively.

The two back bands 40 are respectively mounted at the thigh parts 14 of the left and right halves 11, 12 of the pant body 10 in the middle in width of the respective back side thereof and extending in the vertical direction. Each back band 40 has a top end 41 connected to the bottom end 32 of the associating rhombic band 30, and a bottom end 42 located at the bottom side of the associating thigh part 14. Further, the back bands 40 are adapted to impart a stretching force to the wearer wearing the functional pants.

The two knee bands 50 are respectively mounted at the knee parts 16 of the left and right halves 11, 12 of the pant body 10. Each knee band 50 comprises a patella ring 51 and a pair of popliteal strips 52*a*, 52*b*. The patella ring 51 is mounted at the front side of the respective knee part 16, defining a patella accommodation area 53 for accommodating the wearer's patella. Further, the bottom end 22 of each front band 20 is connected to the top side of the patella ring 51.

On the other hand, the popliteal strips 52*a*, 52*b* are extended from one lateral side of the patella ring 51 over the back side of the knee part 16 and then connected to the opposite lateral side of the patella ring 51. The pair of popliteal strips 52*a*, 52*b* defines an eye-shaped popliteal area 54 for accommodating the wearer's popliteal. Further, the bottom end 42 of each back band 40 is connected to one popliteal strip 52*a* (the upper one) of the respective knee band 50. Each knee band 50 is adapted to impart a stretching force to the wearer wearing the functional pants, enabling the knee part 16 to be positioned on the wearer's respective knee positively as the wearer is running and avoiding loss of the original design effects due to displacement of the parts of the functional pants relative to the wearer. Further, the patella ring 51 is stretchable in upward, leftward and rightward directions by the front band 20 and the popliteal strips 52*a*, 52*b* and therefore is adapted to protect the patella. Further, the popliteal area 54 defined by the popliteal strip 52*a* provides a space for the bending of the human popliteal, preventing any opression upon the human popliteal.

The two calf band sets 60 are respectively mounted at the two calf parts 15, each calf band sets 60 extends from the inner side of the respective calf part 15 to the outer side of the respective calf part 15 at 45° angle. Each calf band set 60 is formed of a plurality of strips 61, being elongated and fine. The strips 61 may be made adjacent to or overlapped with each other at one of their ends. Further, the calf band sets 60 are adapted to impart a stretching force to the wearer wearing the functional pants.

Taking this design, each calf band set 60 has its one end kept adjacent to the junction of the wearer's soleus muscle and achilles tendon, and its other end disposed adjacent to the wearer's gastrocnemius. Thus, the calf band sets 60 can buffer the pressure bearing by the soleus muscles, gastrocnemiuses and other calf muscles, providing the effects of decompression, buffering and fatigue-reducing.

The functional pants further comprise two leg straps 70 respectively mounted at the bottom side of each of the two calf parts 15 for enabling the wearer's feet to pass through, avoiding dislocation of the bottom sides of the calf parts 15. In other practical embodiments, an elastic band can be mounted around the bottom side of each calf part 15 to avoid dislocation of the bottom sides of the calf parts 15. In this case, the two leg straps 70 can be eliminated.

It is to be noted that the aforesaid various bands can be made of spandex fiber or rubber, and mounted on the inner lining or outer surface of the pant body, or between two layers of the pant body. If spandex fiber is selected, it can be integrally woven with another part of the pant body to provide a stretching force wearing the functional pants. Further, since the wearer needs to apply more force in extending the leg then in lifting the leg while running, the stretching force imparted by the back bands 40 is preferably larger than the stretching force imparted by the front bands 20. To achieve this effect, the width of the back bands 40 can be made larger than the width of the front bands 20, or alternatively, the back bands 40 and the front bands 20 can be made of materials that have the same width but different structural densities respectively.

Figure 4:
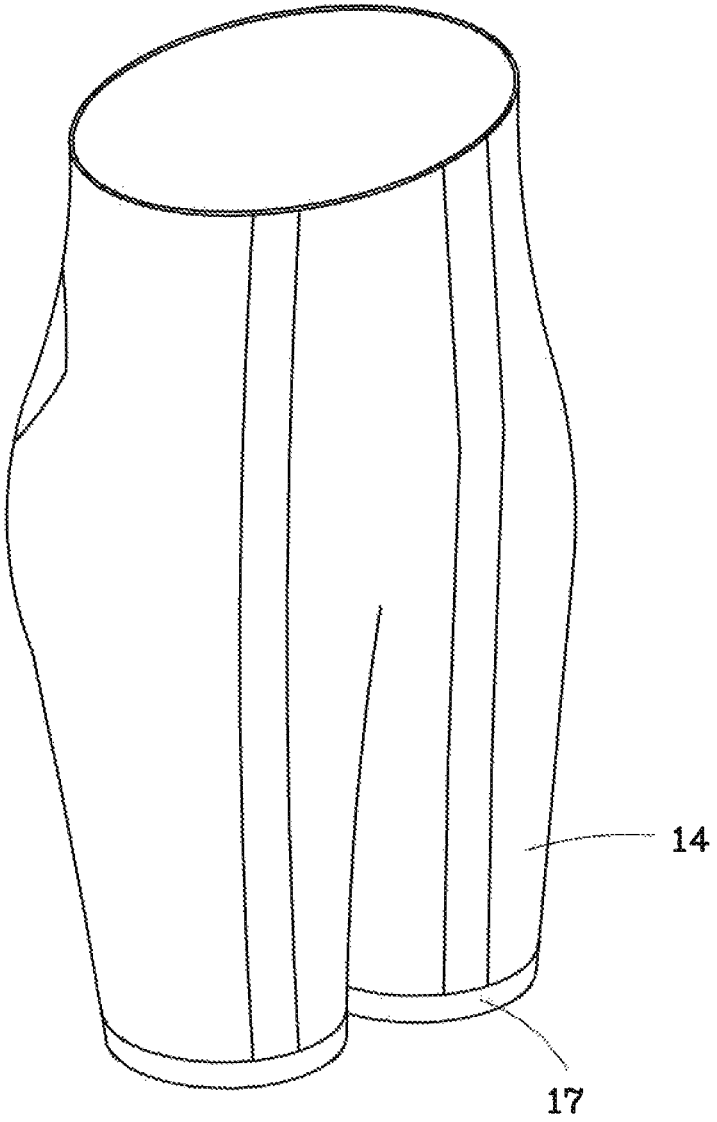
FIG. 4 is an elevational view of functional pants in accordance with a second embodiment of the present invention.
Figure 5:
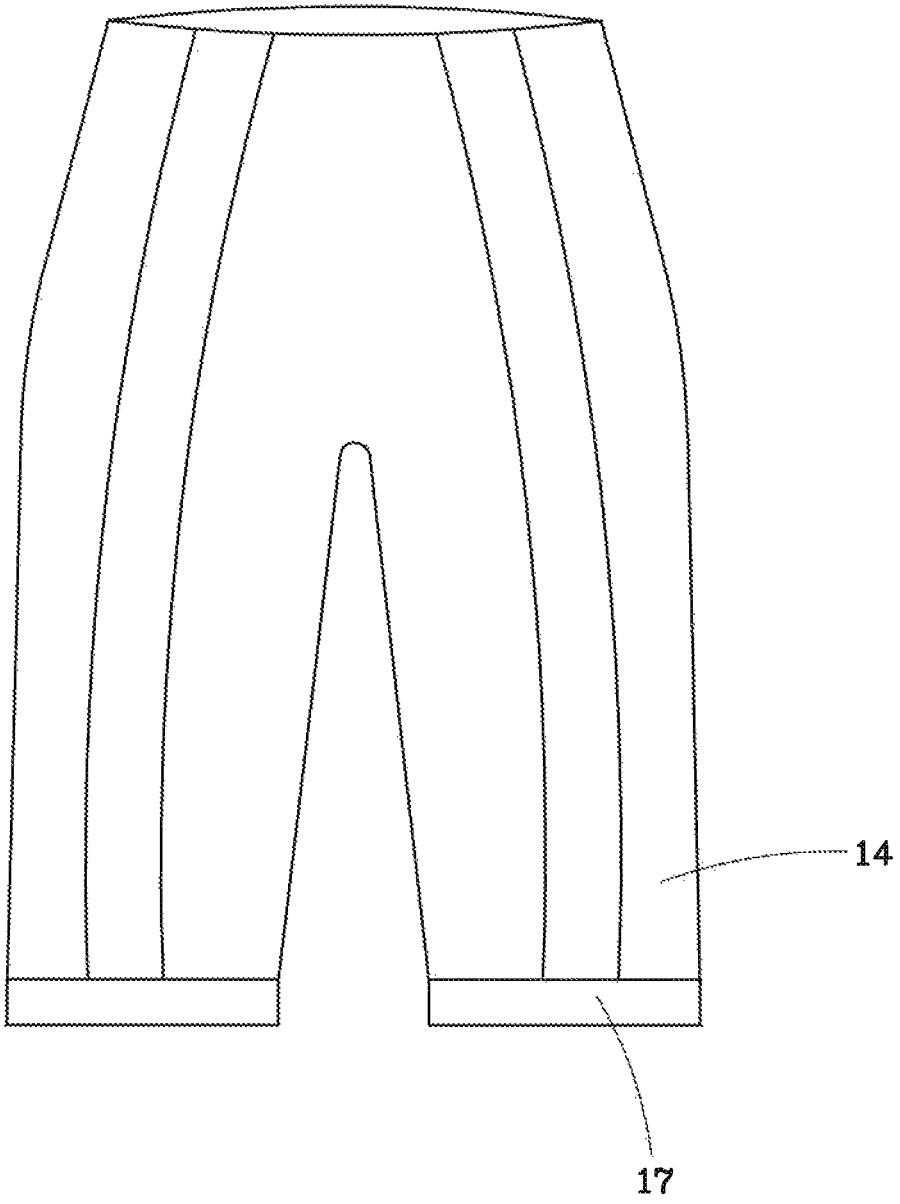
FIG. 5 is a front view of the functional pants in accordance with the second embodiment of the present invention.
Figure 6:
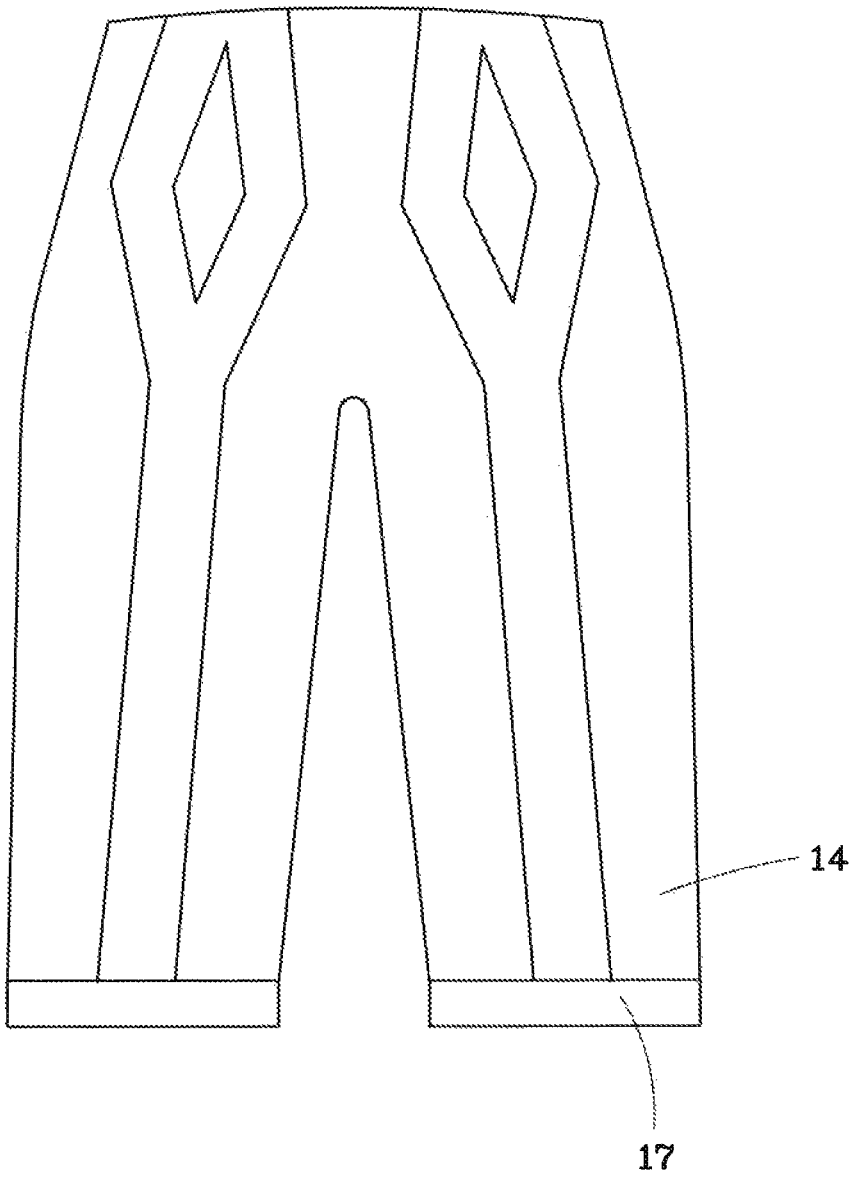
FIG. 6 is a rear side view of the functional pants in accordance with the second embodiment of the present invention.

FIGS. 4-6 illustrate functional pants in accordance with a second embodiment of the present invention. According to this second embodiment, the functional pants are knee-length short pants. This second embodiment is substantially similar to the aforesaid first embodiment with the exception that the part of the pants below the knee parts is eliminated, and an elastic band 17 is mounted around the bottom side of each thigh part 14 to avoid dislocation of the bottom side of each thigh part 14.

Figure 7:
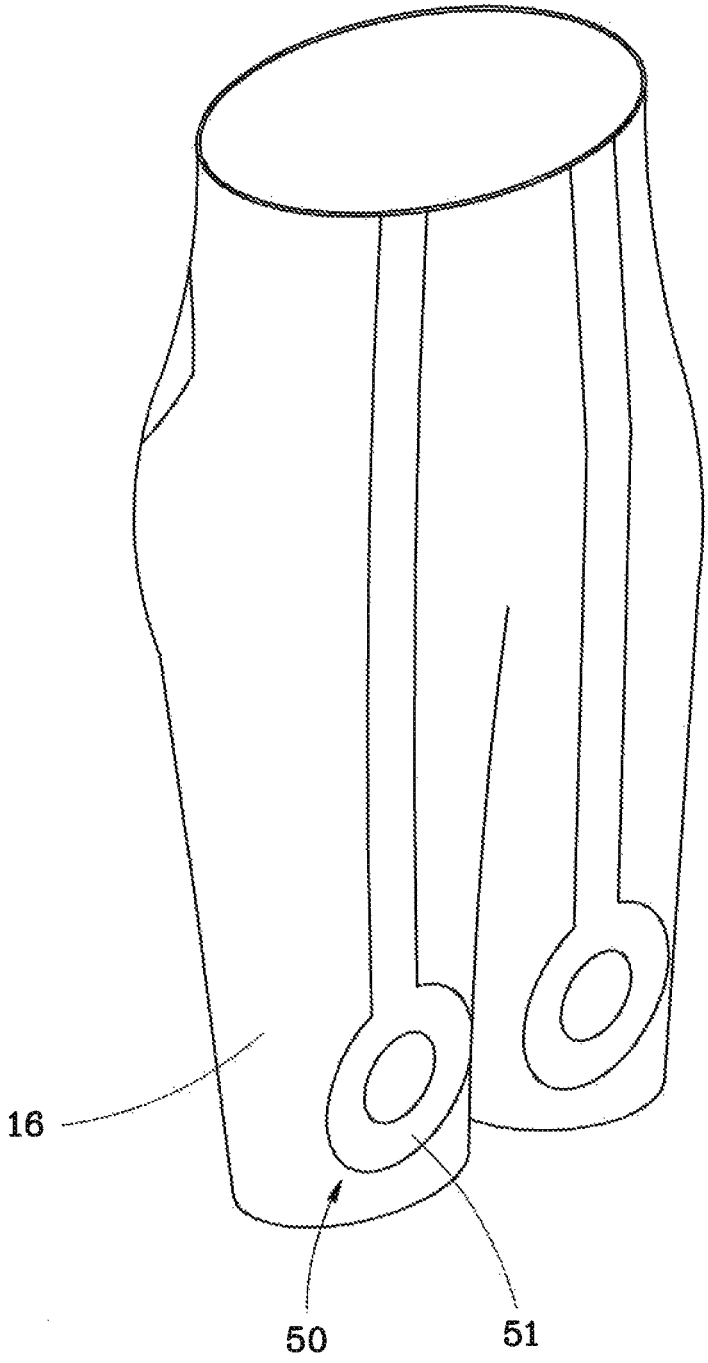
FIG. 7 is an elevational view of functional pants in accordance with a third embodiment of the present invention.

FIG. 7 illustrates functional pants in accordance with a third embodiment of the present invention. This third embodiment is substantially similar to the aforesaid first embodiment with the exception that the calf parts 15 are eliminated while maintaining the knee parts 16; each knee band 50 simply comprises a patella ring 51.

The aforesaid three embodiments have the common features that the two rhombic bands are disposed corresponding to the wearer's gluteus medius muscles that work to extend and lift the legs during a long-distance running; the rhombic bands enhance the extensibility of the gluteus medius muscles, reducing fatigue; the top ends of the rhombic bands are respectively extended to the top sides of the respective thigh parts to support the vertical muscle of the wearer's back, improving the tightness of the vertical muscle and reducing fatigue during a long-distance running. Further, the front and back bands alternatively impart a stretching force to the wearer when the wearer's legs are repeatedly kicking and lifting during running, enabling the wearer to run with less effort.

After several trials by athletes, the functional pants have a significant effect on enhancing the performance of long-distance running and reducing fatigue. Therefore, the invention does satisfy the needs of users.

Although particular embodiments of the invention have been described in detail for purposes of illustration, various modifications and enhancements may be made without departing from the spirit and scope of the invention, for example, the lengths of the bands can be made adjustable. Accordingly, the invention is not to be limited except as by the appended claims.

What is claimed is:

1. Functional pants, comprising:

a pant body comprising left and right halves, each said half comprising a hip part and a thigh part, a crotch being defined at a joint of the thigh parts of said left and right halves, each said hip part having a bottom side kept with said crotch at a same elevation;

two front bands respectively mounted at said left and right halves of said pant body in a middle in width of a respective front side thereof and extending in a vertical direction, each said front band comprising a top end located at a top side of the respective hip part and a bottom end located at a bottom side of the respective thigh part;

two rhombic bands respectively mounted at the hip parts of said left and right halves of said pant body in a middle in width of a respective back side thereof, each said rhombic band comprising a top end located at a top side of the respective hip part and a bottom end located at the bottom side of the respective hip part, each said rhombic band outlining a separate interior stretch region, said stretch region having a shape gradually increasing in width in a direction from the top end of the respective rhombic band toward the bottom end of the respective rhombic band in an upper part of the stretch region and then gradually reducing toward the bottom end of the respective rhombic band in a lower part of the stretch region, the widest area of said stretch region being corresponding to one half of the height of the respective hip part; and two back bands respectively mounted at the thigh parts of said left and right halves of said pant body in the middle in width of a respective back side thereof and extending in the vertical direction, each said back band comprising a top end connected to the bottom end of the respective rhombic band and a bottom end located at the bottom side of the respective thigh part, wherein the widest area of the stretch region defined by each said rhombic band defines a first width; the back side of each said hip part defines a second width corresponding to the widest area of the stretch region, said first width being one third of said second width.

2. The functional pants as claimed in claim 1, wherein each said left and right halves further comprises a knee part connected to the bottom side of the respective thigh part; the functional pants further comprises two knee band mounted at said knee parts respectively, each said knee band comprises a patella ring mounted at a front side of the respective knee part, each said patella ring defines a patella accommodation area for accommodating the wearer's patella, the bottom end of each said front band is connected to a top side of the respective patella ring.

3. The functional pants as claimed in claim 1, wherein each of said left and right halves further comprises a calf part and a knee part connected between the respective thigh part and the respective calf part; the functional pants further comprises a calf band set mounted at each said calf part and extending from an inner side of the respective calf part upwardly to an outer side of the respective calf part.

4. The functional pants as claimed in claim 3, wherein each said calf band set comprises a plurality of strips.

5. The functional pants as claimed in claim 3, further comprising two knee bands mounted at the knee parts respectively, each said knee band comprising a patella ring, said patella ring being mounted at a front side of the respective knee part and defining a patella accommodation area for accommodating the wearer's patella, the bottom end of each said front band being connected to a top side of said patella ring.

6. The functional pants as claimed in claim 5, wherein each said knee band further comprises a pair of popliteal strips both extended from one lateral side of said patella ring over a rear side of said knee part and connected to an opposite lateral side of said patella ring, said pair of popliteal strips defining an eye-shaped popliteal area for accommodating the wearer's popliteal, the bottom end of each said back band being connected to one of the popliteal strips of the respective knee band.

7. The functional pants as claimed in claim 1, wherein a width of each said back band is larger than that of each said front band.

* * * * *